US010322855B2

(12) United States Patent
Heiberger et al.

(10) Patent No.: US 10,322,855 B2
(45) Date of Patent: Jun. 18, 2019

(54) SPORTS BOTTLE CAP

(71) Applicant: PRODUCT ARCHITECTS, INC., Boulder, CO (US)

(72) Inventors: Robert Heiberger, Boulder, CO (US); David Roecker, Denver, CO (US)

(73) Assignee: HYDRAPAK LLC, Oakland, CA (US)

( * ) Notice: Subject to any disclaimer, the term of this patent is extended or adjusted under 35 U.S.C. 154(b) by 0 days.

(21) Appl. No.: 15/715,019

(22) Filed: Sep. 25, 2017

(65) Prior Publication Data

US 2018/0086517 A1 Mar. 29, 2018

Related U.S. Application Data

(60) Provisional application No. 62/398,728, filed on Sep. 23, 2016.

(51) Int. Cl.

| | |
|---|---|
| ***B65D 47/20*** | (2006.01) |
| ***B65D 41/02*** | (2006.01) |
| ***B05B 11/04*** | (2006.01) |
| ***B65D 47/24*** | (2006.01) |

(52) U.S. Cl.

CPC ..... *B65D 47/2093* (2013.01); *B05B 11/047* (2013.01); *B65D 41/023* (2013.01); *B65D 47/2031* (2013.01); *B65D 47/242* (2013.01); *B65D 47/243* (2013.01); *B65D 47/247* (2013.01); *B65D 2251/20* (2013.01)

(58) Field of Classification Search

CPC ..... B65D 47/243; B65D 47/247; B65D 47/2093; B65D 47/241; B65D 47/245

See application file for complete search history.

(56) References Cited

U.S. PATENT DOCUMENTS

| | | | | |
|---|---|---|---|---|
| 2,969,168 | A * | 1/1961 | Newby | B65D 47/247 222/498 |
| 3,201,013 | A | 8/1965 | Porter et al. | |
| 3,240,399 | A | 3/1966 | Frandeen | |
| 3,294,294 | A * | 12/1966 | Amburgey | B65D 47/247 222/525 |
| 3,511,420 | A * | 5/1970 | Kessler | B65D 47/247 222/525 |
| 4,428,508 | A | 1/1984 | Gardikas et al. | |

(Continued)

FOREIGN PATENT DOCUMENTS

| | | |
|---|---|---|
| WO | WO 97/33804 | 9/1997 |
| WO | WO 97/44247 | 11/1997 |
| WO | WO 98/38103 | 9/1998 |

OTHER PUBLICATIONS

International Search Report and Written Opinion for International (PCT) Patent Application No. PCT/US2018/52664, dated Jan. 18, 2019 10 pages.

*Primary Examiner* — J C Jacyna

(74) *Attorney, Agent, or Firm* — Sheridan Ross P.C.

(57) ABSTRACT

A fluid container is disclosed with a cap body made of rigid or semi rigid material and a valve body disposed within the cap body and movable between and open and closed position. The valve body is made of a semi flexible semi rigid material that has a coefficient of thermal linear expansion that is smaller than that of the cap body. The cap body and nozzle valve are configured with three different hermetic seals to counteract the effects of exposure to heat and cold over time and thereby extend the useful life of the cap and valve.

20 Claims, 9 Drawing Sheets

(56) References Cited

U.S. PATENT DOCUMENTS

| | | | | |
|---|---|---|---|---|
| 4,457,454 | A | 7/1984 | Meshberg | |
| 4,629,098 | A | 12/1986 | Eger | |
| 4,976,364 | A | 12/1990 | Soloman | |
| 5,022,562 | A | 6/1991 | Lurkis et al. | |
| 5,094,363 | A | 3/1992 | Monahan et al. | |
| 5,145,094 | A | 9/1992 | Perlmutter | |
| 5,494,198 | A | 2/1996 | Heiberger | |
| 5,607,073 | A | 3/1997 | Forrer | |
| 5,651,471 | A | 7/1997 | Green | |
| 5,669,427 | A | 9/1997 | Hasper et al. | |
| 5,775,528 | A | 7/1998 | Wohlgemuth et al. | |
| 5,788,125 | A | 8/1998 | Steiner et al. | |
| 5,839,623 | A | 11/1998 | Losenno et al. | |
| 5,850,908 | A | 12/1998 | Jasek | |
| 6,029,855 | A | 2/2000 | Adams | |
| 6,095,382 | A * | 8/2000 | Gross | B65D 47/242 215/271 |
| 7,753,234 | B1 * | 7/2010 | Heiberger | B65D 47/243 222/153.09 |
| 8,646,663 | B2 | 2/2014 | Heiberger | |
| 9,102,447 | B2 * | 8/2015 | Pils | B65D 47/243 |
| 2013/0214012 | A1 | 8/2013 | Pils et al. | |

* cited by examiner

SPORTS BOTTLE CAP

CROSS-REFERENCE TO RELATED APPLICATIONS

The present application claims the benefit, under 35 U.S.C. § 119(e), of U.S. Provisional Application Ser. No. 62/398,728 filed Sep. 23, 2016 entitled "Sports Bottle Cap," the entirety of which is incorporated herein by this reference.

FIELD OF THE INVENTION

The present invention relates generally to fluid containers and, more particularly, to closure mechanisms for drinking bottles such as sports and water bottles. Specifically, the present invention relates to pop-up type valve assemblies for fluid container closure mechanisms.

BACKGROUND OF THE INVENTION

With most plastic water bottles, the cap body is made from a rigid or semi rigid material and the nozzle valve is made from a semi rigid semi flexible material. Typically, the material from which the cap body is made has a greater thermal linear expansion than the material from which the nozzle body is made. As a result, the nozzle valve can experience creep in size over time when subject to relatively extreme thermal conditions and hermetic or hydraulic sealing can be lost. As used herein, the terms hermetic and hydraulic are interchangeable. Creep can also result from mechanical events or the combination of thermal and mechanical events.

As here, where the nozzle body and cap body have different thermal linear expansion coefficients, hot and cold events or conditions are both relevant and, depending upon how parts interface, give rise to different issues of creep. Similarly, mechanical expansion and compression forces can give rise to creep. As compared to the cap body, the phenomenon of creep has a greater effect on the nozzle body due to the properties of the semi rigid semi flexible material from which it is made. Expanding or compressing a nozzle valve over time can cause the shape or size of the nozzle body to expand or contract. Further still, the process of creep is accelerated at elevated temperatures and humidity levels, for example, those that occur during a typical dishwasher cleaning and drying cycle. When coupled with mechanical expansion or compression forces acting on a nozzle body, elevated temperatures can drive creep to its mechanical limit altering the size or shape of the nozzle body. Conversely, reduced temperatures, experienced for example when a water bottle is placed in a freezer or when it is filled with relatively cold fluids, are less likely to result in creep because the nozzle body will stiffen and resist the effects of compression. Nonetheless, creep can still be a factor in reduced temperature conditions. In addition, stress can be molded into a component piece, particularly an injection molded part. Exposure to elevated temperatures can release such built-in stress. Often, such stresses cause a part to shrink. Any change in the shape or size of a part that is integral in forming a fluid seal can have a detrimental effect on the seal.

Typically, with current water bottles, when a nozzle valve and cap body are new, there is a press fit between mating parts that cause the semi rigid semi flexible valves to stretch and or compress to form hermetic seals by pressing against the mating surfaces of the cap body. If the parts are left in a stretched and or compressed condition for a period of time and subjected to relatively heightened thermal conditions, for example the wash/dry cycle of a dishwasher, the semi flexible semi rigid nozzle valve will deform or creep to the shape and the size of the mating surfaces of the relatively rigid cap. The net result is that the sealing surfaces lose their ability to press tightly against one another. In one state, the mating geometries are sized identically to one another. Parts that are sized identically will still form a hermetic seal provided the axial and radial alignment between parts does not change. However, when the nozzle valve is toggled from the open to the closed position, the parts will no longer have the same alignment and, therefore, will not form a hermetic seal. In a second state, the mating geometries have changed and the nozzle valve is larger than the mating surface of the cap body. As a result, the ability to form a hermetic seal between the mating parts is lost, regardless of the axial position of the parts.

SUMMARY OF THE INVENTION

According to aspects of the present disclosure, an improved nozzle valve and associated cap for a fluid container are described that address and resolve problems associated with thermal and mechanical creep. Improved methods and structures of forming a hermetic seal between the cap body and nozzle valve are described. These methods and structures address form and fit variations that occur over the life of the fluid container resulting from repeated exposure to elevated and reduced temperatures and mechanical expansion and compression events.

In one embodiment, the improved nozzle valve and cap are intended to be used on a squeezable plastic water bottle. The cap dispenses the fluid contents of the bottle through a cylindrical nozzle valve that opens and closes orifices that direct the flow of the fluid as it is dispensed from the squeezable plastic water bottle. The nozzle valve slides upward and downward within a sleeve in the cap body to toggle between the open and closed modes. When the nozzle valve is pushed downward or inward it is in the closed mode. When the nozzle valve is in the upward or outward most position it is in the open mode.

According to aspects of the present disclosure, to address problems associated with thermally and/or mechanically induced creep over the life of a plastic squeeze bottle, the semi rigid semi flexible nozzle valve and rigid or semi rigid cap body require three sets of hermetic or hydraulic seals. A first set of sealing surfaces facilitates the up and down travel of the nozzle valve when moving from the open and closed positions. These sealing surfaces circumferentially extend around the outer cylindrical surface of the nozzle valve and interface with the inner wall of the sleeve, similar to the function of an O-ring. The nozzle valve is designed with thick wall sections proximate the sealing members to reduce the effects of material creep. Compared to a thinner wall section, the shape memory of a thicker wall section is retained longer. At elevated temperatures, i.e., those of a dishwasher, the cap body and sleeve material expands more than the material of the nozzle valve due to differences in the thermal linear expansion of the materials of the nozzle valve and cap body. The larger thermal expansion of the cap body and sleeve reduces the mechanical force each part imparts against the other and thereby reduces the stresses that cause creep. In a reduced temperature scenario, although the cap and sleeve may contract to a greater degree compared to the nozzle valve, the stiffening of the nozzle valve material inhibits the effect of creep.

The second and third set of sealing surfaces are at the bottom inner diameter and outer diameter of the movable nozzle valve, respectively, and are required to form a hermetic or hydraulic seal when in the closed mode. The inner diameter seal is formed by the distal end of the nozzle valve stretching over a larger diameter cylindrical plug located at the distal end of the sleeve of the cap body. The distal end of the nozzle valve utilizes a thin wall construction because it must not cause frictional forces that hinder the upward and downward travel of the nozzle valve when the user is toggling between the open and closed positions of the nozzle valve. Because it is thinner, it is more susceptible to the effects of creep. In one embodiment, the inner surface of the distal end of the nozzle valve interfaces with the outer surface of the plug at the distal end of the sleeve and the larger diameter outer surface of the plug imparts a mechanical expansion force on the inner diameter surface of the distal end of the nozzle valve. This mechanical stress will cause the nozzle valve material to creep. Exposure to elevated temperature events over time will accelerate the creep. The result of the creep is that the distal end of the nozzle valve will assume a larger diameter. The larger diameter may or may not form a seal when the nozzle valve is in a closed position. However, the nozzle valve will leak when subjected to colder temperatures that cause the cap body to shrink more than the nozzle valve.

A third set of sealing surfaces are formed between the bottom outer diameter of the nozzle valve and a mating surface of the cap body. More particularly, in one embodiment, a cylindrical channel is formed in the cap body that defines an inner surface and an outer surface. When the valve body is in the closed position, the bottom or distal end of the valve body is seated in the channel with the inner diameter of the valve body mating with the inner surface of the channel as described above in connection with the second set of sealing surfaces, and the outer diameter of the valve body mating with the outer surface of the channel (a third set of sealing surfaces). Preferably, the outer surface of the channel and the outer surface of the valve body are configured to force the outer surface of the valve body radially inwardly. In turn, this forces the inner surface of the valve body into engagement with the inner surface of the channel. The radially inward compressive force combats the mechanical expansion force of the outside surface of the plug. In addition, when either hot or cold thermal events happen, the outer diameter sealing surface of the valve body in contact with the outer surface of the channel of the cap body will maintain its hermetic or hydraulic seal and, in addition, force the inner diameter surface of the nozzle valve to compress and maintain its pressure against its mating surface of the cap body to form an affective hermetic or hydraulic seal. Thus, even if some creep were to cause expansion of the shape of the distal end of the valve body, the interface between the outer surface of the channel and the outer surface of the distal end of the nozzle valve counteract the creep and create at least one and preferably two hermetic seals.

This same nozzle valve may optionally contain structure that acts as a self-sealing valve within the said cylindrical nozzle. The self-sealing valve acts as a spill deterrent when the cylindrical nozzle is in the open mode.

The Summary of the Invention is neither intended nor should it be construed as being representative of the full extent and scope of the present invention. Moreover, reference made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, explain the principles of these inventions.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 1:
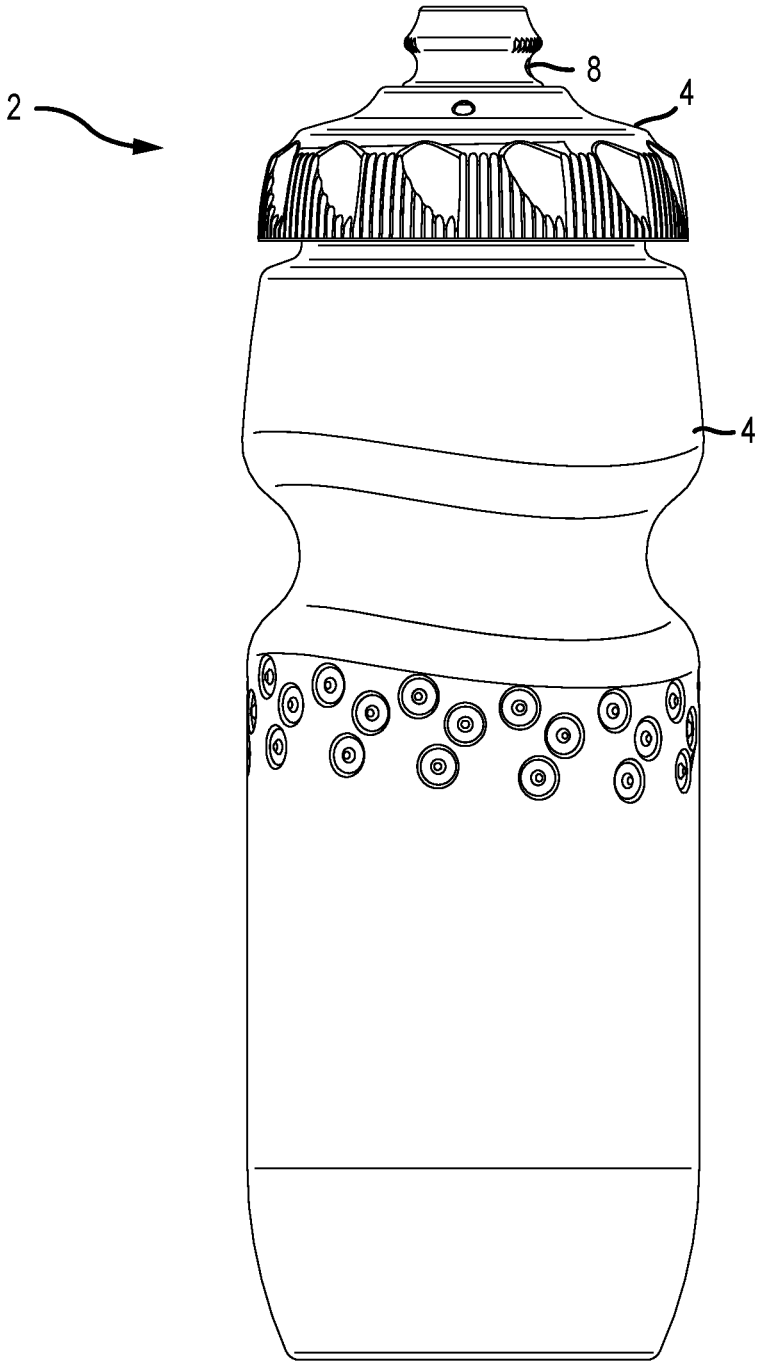
FIG. 1 is an orthogonal view of one embodiment of the top of a cap on a bottle according to aspects of the present disclosure.

FIG. 1 discloses one embodiment of a cap structure 2 that is intended to be used on a squeezable plastic water bottle 4. The cap structure minimally comprises two parts: a body 6 and a nozzle valve 8. The bottle 4 may comprise a variety of shapes. According to aspects of the present disclosure, the bottle 4 is generally cylindrical in shape having a longitudinal axis that extends through the nozzle 8. Other bottle shapes and configurations are within the scope of the present disclosure.

Figure 2:
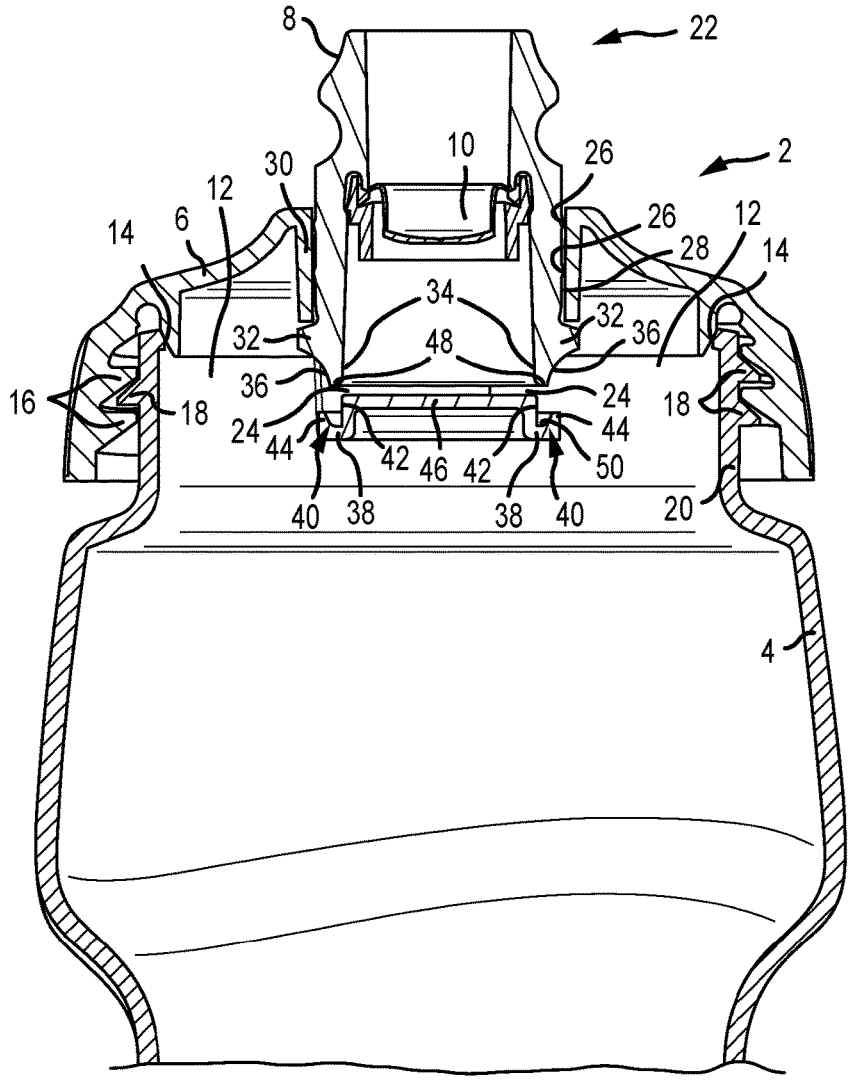
FIG. 2 is a cross section of the cap and bottle of FIG. 1 with the nozzle valve in the open mode.
Figure 3:
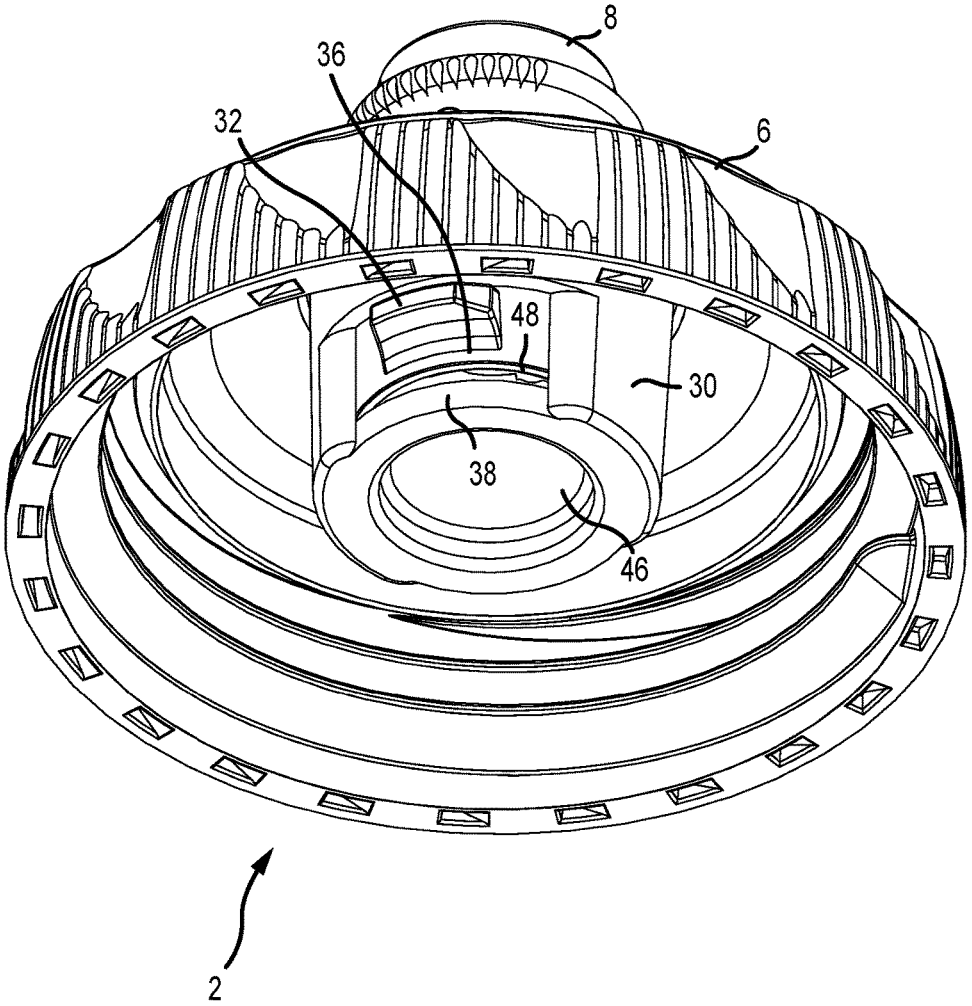
FIG. 3 is a perspective view of the bottom of the cap of FIG. 1, with the valve in the open mode.

With reference to FIG. 2, the cap body 6 is generally cylindrical in nature and sized to form a hermetic seal across the open neck 12 of bottle 4. A sealing surface 14 is formed between the cap 6 and bottle 4 when the screw threads 16 engage mating features 18 of the bottle neck 20. The cap 2 dispenses the fluid contents of the bottle through the proximal end 22 of a cylindrical nozzle valve 8 that acts to open and close orifices 24 (FIG. 2 and FIG. 3) that direct the flow of the fluid as it is dispensed from the squeezable plastic water bottle 4. The cylindrical nozzle valve 8 is toggled from the open position illustrated in FIG. 2 and closed position illustrated in FIG. 4 by the operator. If the nozzle valve 8 is pushed downward or inward it closes or if it is pulled upward or outward it opens. In this configuration, the motion of the nozzle valve 8 is along the longitudinal axis of the bottle 4.

According to aspects of the present disclosure, the cap body 6 is rigid or semi rigid in nature and can be made from any number of rigid or semi rigid materials, for example, impact resistant thermoplastic or impact resistant polyethylene such as high-density polyethylene ("HDPE") and low-density polyethylene ("LDPE"). In contrast, the cylindrical nozzle valve 8 is made from a semi flexible semi rigid material, for example, thermoplastic elastomers (TPE) such as urethane, silicone, natural rubber, synthetic rubber or polyimide, because the soft properties of these materials are good for accommodating surface imperfections and a press fit required in forming effective hermetic or hydraulic seals. Due to the material from which it is made, the cap body 6 has a coefficient of thermal linear expansion that is larger than the coefficient of thermal linear expansion of the nozzle valve 8. Conversely, due to the material from which it is made, the nozzle valve 8 has a coefficient of thermal linear expansion that is less than the coefficient of thermal expansion of the cap body 6. In addition, the semi flexible semi rigid materials of the valve body 8 accommodate a user that might tug on the nozzle valve 8 with his teeth to pull it upward into the open mode while taking a drink.

Figure 4:
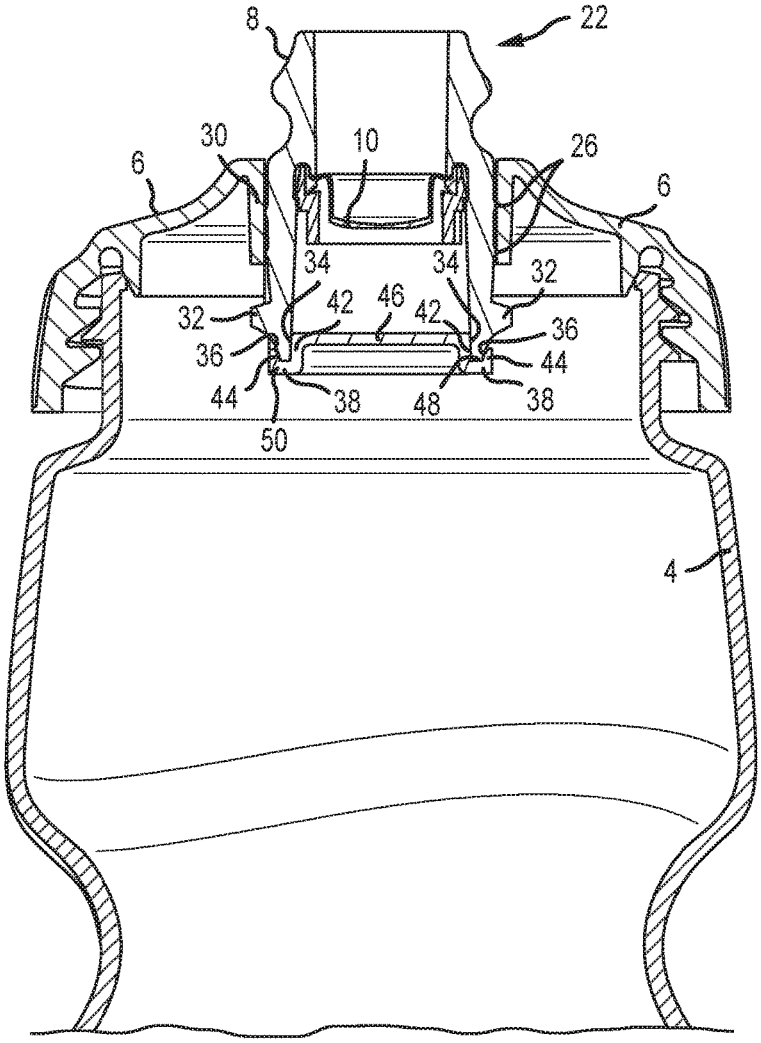
FIG. 4 is a cross section of the cap of FIG. 1 through with the nozzle valve, with the valve in the closed mode.
Figure 5:
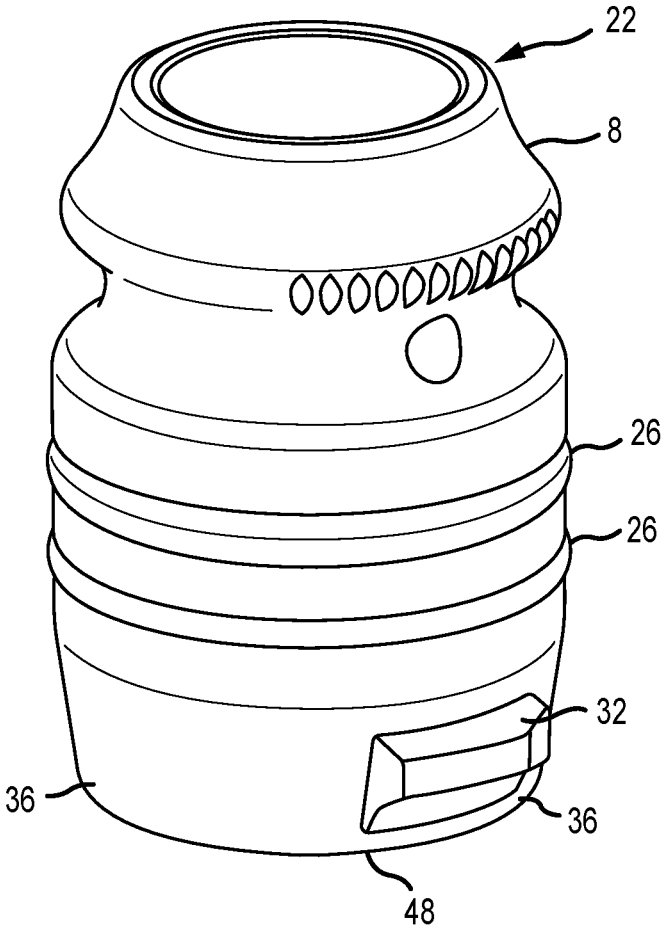
FIG. 5 is a perspective view of the nozzle valve of FIGS. 1-4.
Figure 7:
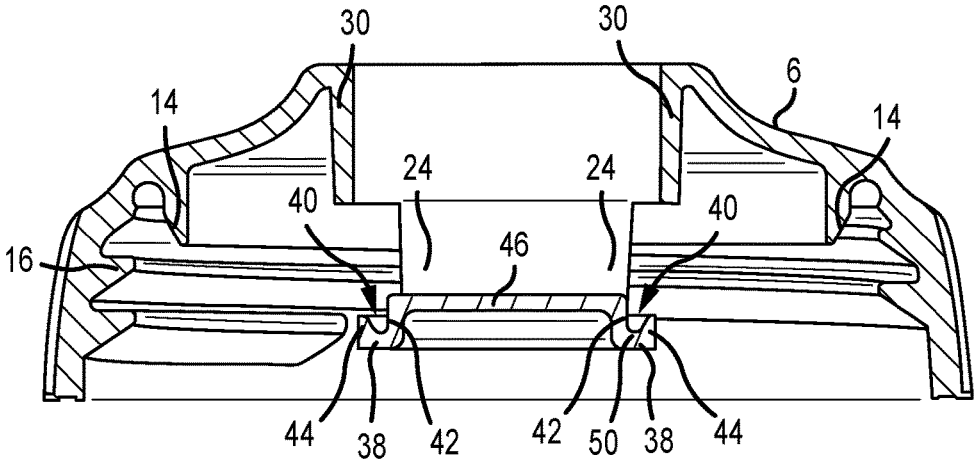
FIG. 7 is a cross section view of the cap body of FIGS. 1-4.

According to aspects of the present disclosure, the nozzle valve 8 may be configured with one or more sealing members 26 formed around the exterior surface, for example, in an O-ring geometry (FIGS. 2 and 4), that form a hermetic seal by pressing against the inner surface 28 of a sleeve 30 formed in the cap body 6 in both the open and closed modes of the plastic cap 2. The sleeve 30 includes one or more orifices 24 that extend through the wall of the sleeve and permit fluid to flow through the sleeve and out the proximal end of the nozzle valve 8 when the nozzle valve 8 is not in the closed position. In one embodiment, the bottom or distal end of the nozzle valve 8 defines an inner surface 34 and an outer surface 36. The thickness of the nozzle valve 8 between the surfaces 34 and 36 at the distal end of the nozzle valve 8 is relatively thin, and preferably thinner than the thickness of the valve 8 proximate the sealing members 26. At least one ear 32 projects radially outwardly from the valve body 8 and is disposed within at least one orifice 24. Preferably, the nozzle valve comprises at least one ear 32 positioned in two different orifices 24. A plug 46 closes the distal end of the cylindrical sleeve 30 and a radially outwardly projecting lip 38 is formed radially outwardly from the plug 46 at the bottom or distal end of the cylindrical sleeve 30. A channel 40 is formed in the lip 38 and defines an inner surface 42 and an outer surface 44. The distal end of the nozzle valve 8 forms a hermetic seal at the bottom inner diameter surface 34 and bottom outer diameter surface 36 by pressing against surfaces 42 and 44 (FIG. 7) of the cap body 6, respectively, as shown in FIG. 4. In preferred embodiments, surface 42 is cylindrical, polished and molded without draft. The reason it is preferable that surface has no draft is to maximize the length of contact between surfaces 34 and 42 while the nozzle valve is sliding from the open position to the closed position. When in a closed position, the bottom surface 48 of the nozzle valve 8 may engage the bottom surface 50 of the channel, as shown in FIG. 4. Alternatively, the bottom 50 of the channel may be spaced from the bottom 48 of the valve body 8 with the surfaces 42 and 44 could be sized differently, having a longer dimension parallel with the longitudinal axis of the bottle.

According to aspects of the present disclosure, the diameter of surface 42 is sized larger than the diameter of surface 34 (FIG. 6) of the nozzle valve 8 to create a press fit between the flexible nozzle valve and the more rigid cap body. In one embodiment, the diameter of surface 42 is 0.010 inches larger than the diameter of surface 34. When surface 34 of the nozzle valve is pushed over surface 42 of the cap body it stretches to form a hermetic seal between the interfering surfaces. In a preferred embodiment, the valve nozzle is stretched approximately but not limited to 2%. It should also be noted that the wall thickness of the nozzle valve between surfaces 34 and 36 is small or thin enough to allow the users to stretch surface 34 across surface 42 without requiring excessive force to be supplied by the user when toggling the nozzle valve between the open mode to the closed mode. Furthermore, surface 36 of the nozzle valve presses against surface 44 of the cap body to form another hermetic sealing surface and to wedge or force the inner surface 34 of the nozzle valve 8 more tightly against surface 42 of the cap body. In a preferred embodiment, the distal end of the nozzle valve 8 and the channel 40 are substantially cylindrical and the outer surface 44 of the channel 40 is configured to press the outer surface 36 of the distal end of the nozzle valve 8 radially inwardly such that the inner surface 34 of the distal end of the nozzle valve 8 forms a sealed engagement with the inner surface 42 of the channel 40. Simultaneously, the outer surface 44 of the of the channel 40 forms a sealed engagement with the outer surface 36 of the distal end of the nozzle valve 8. Alternatively, the outer surface 36 of the distal end of the nozzle valve 8 may be configured to interface with the outer surface 44 of the channel to achieve the same radially inwardly directed force.

The material creep of the semi flexible nozzle valve 8 is exaggerated by the fact that the mating parts, the nozzle valve 8 and the sleeve 30, have two different coefficients of thermal linear expansion. In a preferred method of construction, the cap body 6 is made from a polyethylene resin with a coefficient of linear thermal expansion of 120 micro inch/inch Fahrenheit and the nozzle valve 8 is made from a thermoplastic urethane with a coefficient of linear thermal expansion of 85 micro inch/inch Fahrenheit. This difference can result in a relative difference in linear expansion of 0.002 inches across the geometry of features 34 and 42 assuming a dishwasher temperature of 150 F. and a diameter of 0.750 inches, which is a preferred structure of surface 42. In other words, surface 42 which stretches surface 34 when the nozzle valve 8 is in the closed position, expands 0.002 inches more than the semi flexible semi rigid nozzle valve 8 would grow when subjected to the same elevated temperature of 150° F. In addition, at the elevated temperatures discussed, the nozzle valves 8 have a greater tendency to lose their elastic memory and thereby dimensionally creep to a larger or expanded shape or diameter. When the bottle cap 2 cools down to room temperature from the elevated temperatures of the dishwasher, the mating parts will not be sized the same as before the extreme temperature event. The mating surface 34 and 42 will either be sized identically to one another such there is no longer a pressing between them or there will be a gap between the sealing surfaces 34 and 42 depending on the number of dishwashing cycles and the age of the parts. Furthermore, as these same parts are subjected to freezing temperatures, surface 42 with the larger coefficient of linear thermal expansion will shrink more than the nozzle valve sealing surface 34 which will create a gap between sealing surfaces 34 and 42. The net result is that the interface at surfaces 34 and 42 will leak absent the presence and influence of sealing surfaces 36 and 44.

To assist in addressing the foregoing issue, in a preferred embodiment, sealing surface 44 (FIGS. 2 and 4) of the cap body is angled to wedge or force the inside surface 34 of the nozzle valve against surface 42 of the cap body by pressing on the circumference 36 of the nozzle valve 8. The radially inwardly directed force can be enhanced or varied by the altering the shape of surface 44 and/or the complementary surface 36. As illustrated in FIGS. 2 and 4, the surfaces 36 and 44 are angled or slanted to press or force the distal end of the valve 8 radially inwardly. As will be appreciated by those of ordinary skill in the art after review of the present disclosure, other geometric shapes can be substituted for the angled surfaces 36 and 44 with the same result, and such alternative configurations are deemed within the scope of the present disclosure. For example, one surface (36 or 44) could be aligned generally parallel with the longitudinal axis of the nozzle valve 8, and the other surface could be angled relative to the longitudinal axis of the nozzle valve 8. The surface generally parallel to the longitudinal axis would be substantially cylindrical while the surface disposed at an angle relative to the longitudinal axis would be frusto-conical in shape. This strategy accounts for and is tolerant of the effects at the elevated temperatures within a dishwasher that produce creep in the nozzle valve because outer surface 44 and inner surface 42 trap surfaces 34 and 36 between them with enough force to keep sealing surfaces in contact and without causing creep in the distal end of the nozzle valve 8 between surfaces 34 and 36 of the semi rigid semi flexible nozzle valve 8. In other words, if the nozzle valve is subject to multiple thermal events, such as numerous dishwasher cycles, with the nozzle valve 8 in the closed position, the tendency of the diameter of the distal end of the nozzle valve 8 to increase to the diameter size of the inner surface 42 of the channel 40 is counteracted by the presence of the interface between the outer surface 44 of the channel 40 and the outer surface 36 of the nozzle valve 8 which acts to prevent expansion of the diameter of the distal end of the nozzle valve. Similarly, if the nozzle valve is in the open position during multiple thermal events, even if the distal end did tend to enlarge over time, the presence and operation of the outer surface 44 of the channel 40 acting on the outer surface 36 of the distal end of the nozzle valve will compel the inner surface 34 of the distal end of the nozzle valve into contact with the inner surface 42 of the channel 40.

Figure 6:
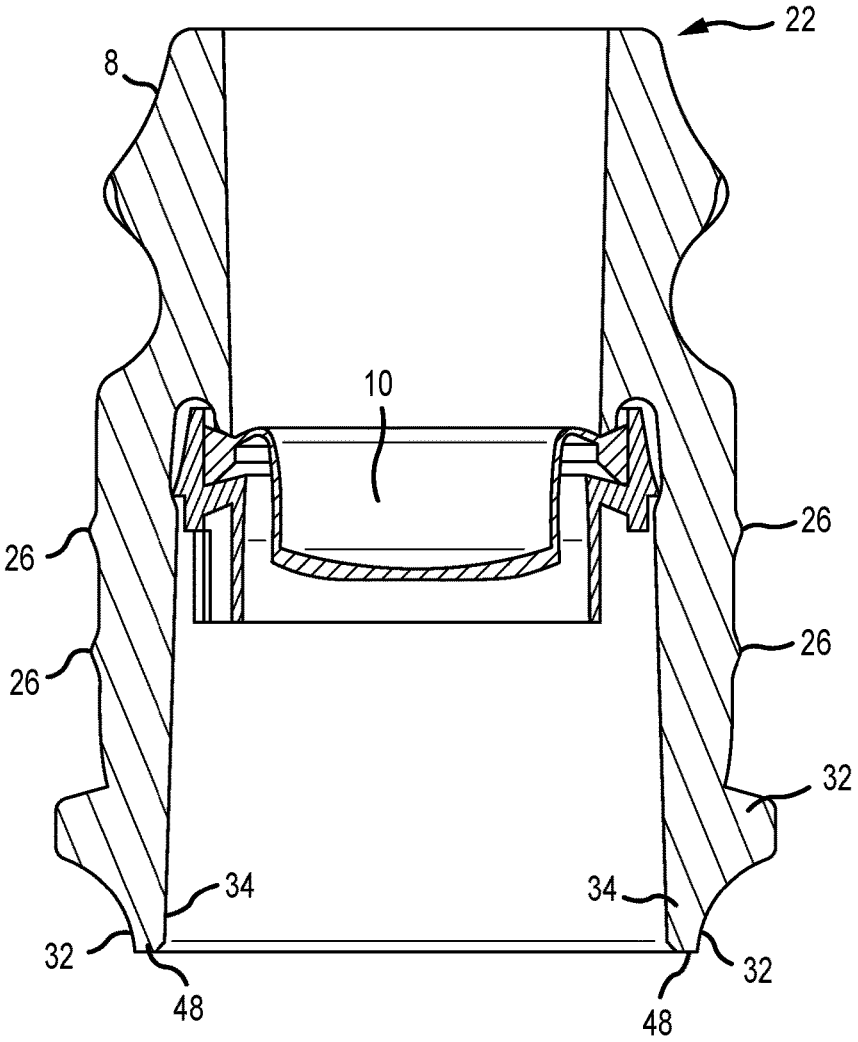
FIG. 6 is a cross section view of one embodiment of a nozzle valve according to aspects of the present disclosure with an integral self-sealing valve.

When analyzing creep and size variations of the sealing members 26 of the nozzle valve 8, previous discussions do not apply. In this case, the geometry of the body of the nozzle valve was selected to keep part stresses below the level required for plastic deformation of the semi rigid semi flexible nozzle valve 8. The wall thickness of the nozzle valve between the geometry of the sealing member 26 and surface 46 of FIG. 6 is increased such that internal stresses will not exceed the threshold of plastic deformation at or below room temperature. A thicker wall section also maintains shape memory longer compared to a thinner wall section. Thicker wall sections are permissible in this area of the nozzle valve 8 because the frictional forces experienced by the user when toggling the nozzle valve open and closed are a small percentage of the radial force that compresses the sealing members 26 against surface 28 of the cap body FIG. 7.

Furthermore, when the first sealing features 26 are subjected to the elevated temperatures of a dishwasher, the cap body surface 28 will expand to a larger diameter than the nozzle valve 8 due to the larger coefficient of linear thermal expansion of the cap body material. More specifically, the diameter of surface 28, which preferably is 0.950 inches, will be 0.0025 inches larger than the O-ring geometry of the first sealing features 26 at the elevated temperatures of a dishwasher. The net effect is that the sealing features 26 will be less likely to be affected by creep because there is less compression of the sealing surfaces 26 of the nozzle valve against the surface 28 of the cap body at the elevated temperatures that are likely to cause creep.

Figure 8:
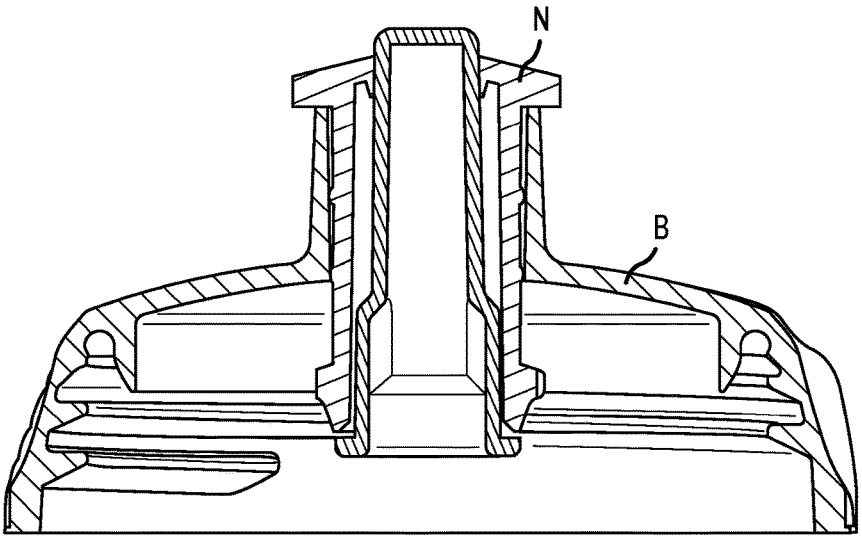
FIG. 8 is a section view of a generally accepted plastic cap for a flexible water bottle.

According to aspects of the present disclosure, the valve 8 may optionally include a self-sealing valve 10 as shown in FIG. 2 that acts as a spill deterrent when the cap is in the open mode (FIG. 3) and the bottle is tipped over. Examples of such an anti-spill valves are available from Aptar, Inc., Crystal Lake, Ill. FIG. 8 shows an example of a section view of a generally accepted structure of a plastic cap without a self-sealing valve. A cap body B and a movable nozzle N are illustrated. Exemplary embodiments of a movable nozzle without a self-sealing valve are disclosed in U.S. Pat. Nos. 7,753,234 and 8,646,663, the entirety of which are incorporated herein by reference.

This self-sealing valve 10 is housed within the nozzle valve 8 and requires a different method of forming a hermetic seal between the nozzle valve 8 and cap body 6 that is generally understood in the market place for plastic caps that do not incorporate a self-sealing valve 10.

Figure 9:
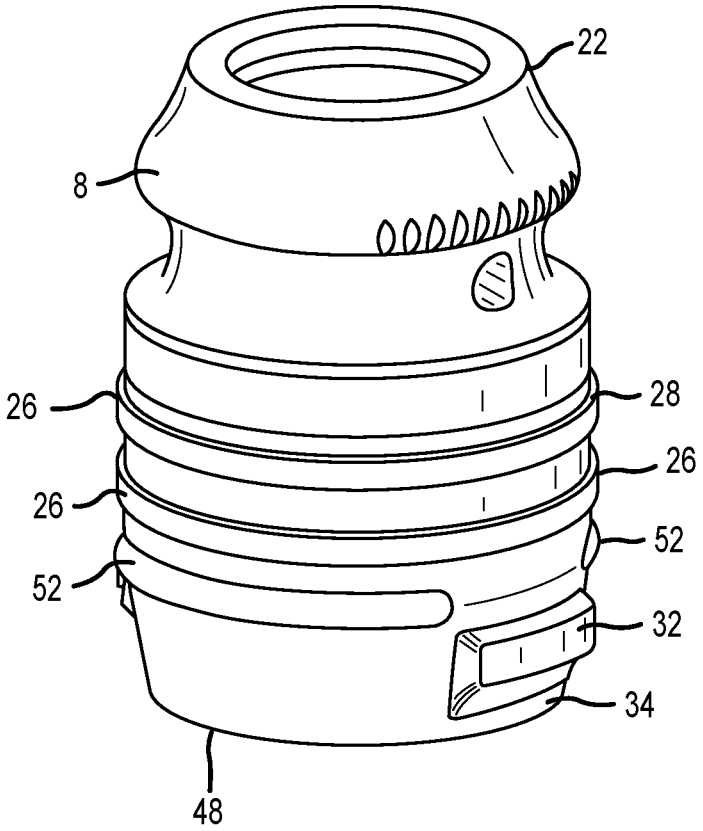
FIG. 9 is a perspective view of an alternative embodiment of the nozzle valve.

According to aspects of the present disclosure, an alternative embodiment of the valve body 8 is illustrated in FIG. 9. As shown, the exterior of the valve body 8 optionally includes a stabilizing feature 52. This feature provides stability to the movement of the nozzle valve 8, particularly preventing or reducing rocking that would cause axial misalignment of the nozzle valve relative to the sleeve due to heavy side loads.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Other modifications or uses for the present invention will also occur to those of skill in the art after reading the present disclosure. Such modifications or uses are deemed to be within the scope of the present invention.

What is claimed is:

1. A container that is adapted to hold a fluid for dispensing, comprising:

(a) A container having an opening;

(b) a cap member mountable to the container and enclosing the opening, the cap member having a cylindrically walled sleeve forming an outer opening in the cap member at the proximal end of the sleeve, a plug enclosing the distal end of the sleeve, an annular lip extending radially outwardly from the plug, the lip having an annular outer wall spaced from the plug, and an annular channel formed in the lip, the channel defining an inner surface and an outer surface, and at least one orifice disposed in the sleeve distally of the outer opening and proximally of the outer wall of the lip;

(c) a movable nozzle valve having a generally cylindrical hollow body disposed for longitudinal movement within the cylindrically walled sleeve between an open position to permit flow of a fluid through said hollow body from the container and a closed position to prevent flow of a fluid through the hollow body, the valve body having at least one seal member projecting radially outwardly from an exterior surface and engaging the cylindrically walled sleeve, the valve body having an ear projecting radially outwardly and received in the at least one orifice to define a stop member for limiting movement of the valve body within the sleeve between the open and closed positions, the valve body having a distal end with an inner and outer surface, wherein the distal end of the valve body nests within the channel when the valve is in a closed position, to form a first annular seal between the inner surface of the distal end of the valve body and the inner surface of the channel and a second annular seal between the outer surface of the distal end of the valve body and the outer surface of the channel.

2. The container according to claim 1, further comprising an anti-spill member positioned in the hollow body of the valve.

3. The container according to claim 1, wherein the cylindrically walled sleeve is made from polyethylene and the nozzle valve is made from at least one of urethane, silicone, natural rubber, synthetic rubber and polyimide.

4. The container according to claim 1, wherein the coefficient of thermal linear expansion of the cylindrically walled sleeve is greater than the coefficient of thermal linear expansion of the nozzle valve.

5. The container according to claim 4, wherein the difference in the linear thermal expansion between the cylindrically walled sleeve and the nozzle valve is approximately 0.002 inches for a one-hundred-fifty degrees Fahrenheit temperature rise.

6. The container according to claim 1, wherein the cylindrical hollow body of the nozzle valve has a thickness, and the thickness of the body is greater proximate the at least one seal member than at the distal end of the valve.

7. The container according to claim 1, wherein the outer surface of the channel is configured to force the outer surface of the distal end of the valve body radially inwardly when the outer surface of the channel engages the outer surface of the distal end of the valve body.

8. The container according to claim 1, wherein the inner surface of the channel is substantially cylindrically shaped and the inner surface of the distal end of the valve is substantially cylindrically shaped, and the diameter of the inner surface of the channel is approximately 0.010 inches larger than the diameter of the inner surface of the distal end of the valve.

9. The container according to claim 8, where the diameter of the inner surface of the channel is 0.750 inches.

10. A cap body for closing a fluid container, comprising:

a. an exterior and an interior, and an aperture extending through the cap body;

b. a cylindrical sleeve extending from the aperture on the interior of the cap body and defining a longitudinal axis, the sleeve comprising:

i. a proximal end proximate the aperture;

ii. a closed distal end having a first cylindrical annular surface with a first diameter, and a second annular surface positioned radially outwardly from the first surface, the second surface projecting radially outwardly relative to the first surface;

iii. at least one orifice extending through the sleeve and disposed between the proximal and distal ends;

c. a movable nozzle valve comprising:

i. a cylindrical hollow body with a proximal end and a distal end, an aperture formed in the proximal end, the hollow body disposed within the sleeve and movable within the sleeve between an open position, wherein fluid may pass through the at least one orifice in the sleeve, the hollow body and out the aperture, and a closed position, wherein fluid may not flow through the at least one orifice in the sleeve;

ii. a first sealing member disposed around the interior of the distal end of the cylindrical hollow body;

iii. a second sealing member disposed around the exterior of the cylindrical hollow body and projecting radially outwardly; and iv. at least one ear projecting radially outwardly and received in the at least one orifice to define a stop member for limiting movement of the valve body within the sleeve between the open and closed positions;

wherein, when the nozzle valve is in the closed position, the second surface of the sleeve engages the second sealing surface of the nozzle valve and imposes a radially inward force on the distal end of the nozzle valve to cause the first sealing member of the nozzle valve to form a fluid seal with the first cylindrical surface of the distal end of the sleeve.

11. The cap body according to claim 10, wherein the second annular surface of the distal end of the sleeve is angled relative to the longitudinal axis of the sleeve.

12. The cap body according to claim 11, wherein the second sealing member of the nozzle valve is angled relative to the longitudinal axis of the sleeve.

13. The cap body according to claim 10, further comprising an anti-spill member positioned in the hollow body of the nozzle valve.

14. The cap body according to claim 10, wherein the cylindrical sleeve is made from polyethylene and the nozzle valve is made from at least one of urethane, silicone, natural rubber, synthetic rubber and polyimide.

15. The cap body according to claim 10, wherein the coefficient of thermal linear expansion of the cylindrical sleeve is greater than the coefficient of thermal linear expansion of the nozzle valve.

16. The cap body according to claim 15, wherein the difference in the linear of thermal expansion between the cylindrical sleeve and the nozzle valve is approximately 0.002 inches for a one-hundred-fifty degrees Fahrenheit rise in temperature.

17. The cap body according to claim 10, wherein the body of the nozzle valve has a thickness, and the thickness of the body is greater proximate the second sealing member than at the distal end of the valve body.

18. The cap body according to claim 10, further comprising an annular channel positioned at the distal end of the sleeve, the channel having a first inner surface comprising the first sealing member and a second outer surface spaced radially outward of the first inner surface, the second outer surface comprising the second sealing member, and wherein the distal end of the valve body nests in the channel in the closed position.

19. The container according to claim 1, wherein the inner surface of the channel defines an exterior surface of the plug having a first diameter, the inner surface of the distal end of the hollow body of the nozzle valve defining a second diameter, and wherein the first diameter is larger than the second diameter.

20. The cap body of claim 10, wherein when the nozzle valve is in the closed position, a fluid seal is formed between the second sealing member of the nozzle valve and the second annular surface of the sleeve.

* * * * *